US006562152B2

(12) United States Patent
Murakami et al.

(10) Patent No.: US 6,562,152 B2
(45) Date of Patent: May 13, 2003

(54) HIGH STRENGTH STEEL PLATE HAVING IMPROVED WORKABILITY AND PLATING ADHESION AND PROCESS FOR PRODUCING THE SAME

(75) Inventors: Hidekuni Murakami, Kitakyushu (JP); Yoshihisa Takada, Kitakyushu (JP); Masayoshi Suehiro, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/892,842

(22) Filed: Jun. 27, 2001

(65) Prior Publication Data

US 2002/0017342 A1 Feb. 14, 2002

(30) Foreign Application Priority Data

Jun. 29, 2000 (JP) ..... 2000-196753

(51) Int. Cl.[7] ..... C22C 38/00; C22C 38/18; C23C 8/26

(52) U.S. Cl. ..... 148/320; 148/230; 148/333; 420/128; 428/659

(58) Field of Search ..... 148/320, 318, 148/230, 333; 420/128; 428/659

(56) References Cited

U.S. PATENT DOCUMENTS 4,376,661 A 3/1983 Takechi et al.
5,998,042 A * 12/1999 Tanaka et al. ..... 428/627

FOREIGN PATENT DOCUMENTS

| | | | |
|---|---|---|---|
| DE | 38 06 303 | 10/1989 | |
| JP | 64-79345 | 3/1989 | |
| JP | 4-333552 | 11/1992 | |
| JP | 5-70886 | 5/1993 | |
| JP | 6-145788 | 5/1994 | |
| JP | 410219407 A * | 8/1998 | ..... C22C/38/00 |
| JP | 1-230715 | 9/1998 | |

OTHER PUBLICATIONS

Patent Abstracts of Japan, vol. 1998, No. 1, Jan. 30, 1998. JP 09–241788.

Patent Abstracts of Japan, vol. 18, No. 468, Aug. 31, 1994. JP 06–145788.

Patent Abstracts of Japan, vol. 17, No. 394, Jul. 23, 1993. JP 05–070866.

Sakuma, et al., "Mechanical Properties and Retained Austenite in Intercritically Heat–Treated Bainite–Transformed Steel and Their Variation with Si and Mn Additions", Metallurgical Transactions A. Physical Metallugy and Materials Science, Metallurgical Society of AIME, New York, U.S., vol. 22A, No. 2, Feb. 2, 1991, pp. 489–498.

George E. Totten (editor), Maurice A. Howes, "Steel Heat Treatment Handbook",1997, Marcel Dekker Inc., New York, US, p. 722.

* cited by examiner

*Primary Examiner*—Deborah Yee
(74) *Attorney, Agent, or Firm*—Kenyon & Kenyon

(57) ABSTRACT

A TRIP-type high strength steel plate having good workability is provided which, while reducing the amount of alloying elements added which increase the production cost, ensures a contemplated retained austenite structure, has good adhesion to zinc plating, and can also be applied to highly corrosion resistant surface treated steel plates. The high strength steel plate having improved workability and plating adhesion is such that a high concentration, i.e., 0.03 to 2.0% by weight, of nitrogen is incorporated, the contents of silicon and aluminum, which form nitride, are preferably regulated respectively to not more than 0.5% by weight and not more than 0.3% by weight, and, in addition, calcium, sodium, magnesium, etc. are optionally added to control the formation of iron nitride, whereby the volume fraction of the retained austenite phase in the metal structure is regulated to 3 to 20% by weight.

7 Claims, No Drawings

HIGH STRENGTH STEEL PLATE HAVING IMPROVED WORKABILITY AND PLATING ADHESION AND PROCESS FOR PRODUCING THE SAME

BACKGROUND OF THE INVENTION

1. Field of the Invention

The present invention relates to a high strength steel plate useful as automobile, building, electric and other members, and a process for producing the same, and more particularly to a high strength steel plate which has improved (excellent) punch stretching at the time of press forming and plating adhesion, a high strength alloyed galvanized steel plate, and a process for producing the same.

2. Background Art

For automobiles, studies have been made on a reduction in weight from the viewpoint of coping with a trend in recent years toward a reduction in fuel consumption. In this connection, regarding materials, an attempt to increase the strength has been made so as to ensure satisfactory strength even after a reduction in thickness for weight reduction purposes. Since, however, the workability of materials generally deteriorates with increasing the strength, steel plates satisfying both workability and strength requirements have been desired. Not only elongation in a tensile test but also n value and r value are used as measures of the workability. In recent years where simplification of the step of pressing by one-piece molding is an issue, it is important for the n value corresponding to even elongation to be large.

To this end, hot rolled steel plates and cold rolled steel plates utilizing strain induced transformation, wherein the austenite phase in the metal structure is transformed by working to hard martensite, have been developed. In this case, the transformation to martensite causes the introduction of a large quantity of dislocation in the steel plate and thus results in significantly hardened steel plates. Therefore, a high level of work hardening is maintained, and necking is suppressed, and the evenness of elongation is improved.

This steel plate is such that the steel does not contain expensive alloying elements and contains, as basic alloying elements, about 0.07 to 0.4% by weight of carbon, about 0.3 to 2.0% by weight of silicon, and about 0.2 to 2.5% by weight of manganese and, after the formation of austenite in a high temperature two phase region, transformation to bainite has been carried out at about 400° C., whereby austenite is retained in the metal structure even at room temperature. This steel is generally called "retained austenite steel," "TRIP steel" or the like, and techniques associated with this steel is disclosed, for example, in Japanese Patent Laid-Open Nos. 230715-1989 and 79345-1989.

In these steel plates, however, since the unique transformation to bainite is utilized to retain austenite, a contemplated metal structure cannot be formed without close control of cooling rate from a temperature region, where two phases coexist, and close control of holding conditions (temperature and time) around 400° C. and this is causative of an impediment to good strength and ensuring of elongation and to an improvement in yield at the time of production.

Further, in the application of the steel plate to galvanized steel plates, which, at the present time, are becoming the mainstream in steel plates for automobiles, due to heat history at the time of plating, a failure of the favorable metal structure takes place, and, in addition, the adhesion to zinc is poor due to the presence of 0.3 to 2.0% by weight of silicon. Therefore, good surface corrosion resistance cannot be imparted, and this has impeded extensive industrial utilization of the steel plates.

In order to solve the above problem, for example, Japanese Patent Laid-Open Nos. 333552/1992, 70886/1993, and 145788/1994 disclose, for example, a method for improving the wettability by plating by the addition of nickel, a method for reducing silicon by the addition of aluminum having the same effect as silicon, and a method for multilayer plating of zinc plating and nickel plating having good adhesion to zinc plating.

In these methods, however, for example, the addition of the alloy or the increase in the number of steps increases the production cost, and, in addition, the contemplated metal structure remains unstable. That is, the problem has not been thoroughly solved.

SUMMARY OF THE INVENTION

It is an object of the present invention to provide a high strength steel plate which can ensure a contemplated retained austenite structure through simpler temperature control, has good adhesion to zinc plating, can be applied to highly corrosion resistant surface treated steel plates, and has good workability.

With a view to providing high strength steel plates which can attain the above object, the present inventors have made extensive and intensive studies on the relationship between the suitability for plating and the constituents of the steel plate, which has led to the completion of the present invention. The subject matter of the present invention is as follows.

Nitrogen has hitherto been known as an element for stabilizing an austenite phase. In a conventional production process wherein a high concentration of nitrogen is incorporated at the stage of molten steel, however, refining is difficult. Further, gas is evolved in semi-finished steel products during casting, and gas bubbles remain unremoved after solidification. This makes it impossible to produce good semi-finished steel products. For this reason, the application of high-nitrogen steel to steel plates for working, which is contemplated in the steel according to the present invention, has not been studied, and, thus, the workability and the suitability for plating are unknown. Accordingly, the present inventors have made studies on a method for incorporating nitrogen immediately before the formation of a product after the casting and have found that the incorporation of a large amount of nitrogen is effective in improving the workability and the suitability for plating.

Based on this finding, the present inventors have made further studies, for example, on the influence of elements, such as silicon, manganese, and carbon, and minor elements, such as calcium, sodium, and magnesium, and nitriding conditions and heat history for performing the control of the contemplated metal structure, which has led to the completion of the present invention. The main point is as follows.

(1) Basically, nitrogen is incorporated in a high concentration.

(2) The contents of silicon, aluminum and the like, which form nitrides, are regulated so as to fall within a suitable content range.

(3) Calcium, sodium, magnesium and the like are optionally added to control the formation of iron nitride.

(4) The contents of strengthening elements, such as carbon, silicon, manganese, and phosphorus, are controlled to regulate the strength of each phase constituting the metal structure and to regulate the strength and elongation as the steel plate.

(5) Heat history is controlled so that austenite is further stabilized and is retained in a large amount at room temperature.

Thus, according to the present invention, the following high strength steel plates and production process thereof are provided.

(1) A high strength steel plate having improved workability and plating adhesion, comprising, by weight, nitrogen: 0.03 to 2.0% and having a volume fraction of retained austenite of 3 to 20%.

(2) The high strength steel plate according to the above item (1), which further comprises, by weight, silicon: not more than 0.5%.

(3) The high strength steel plate according to the above item (1) or (2), which further comprises, by weight, carbon: not more than 0.08%.

(4) The high strength steel plate according to any one of the above items (1) to (3), which further comprises, by weight, at least one member selected from the group consisting of manganese: 0.5 to 3.0%, phosphorus: not less than 0.01%, and aluminum: not more than 0.3%.

(5) The high strength steel plate according to any one of the above items (1) to (4), which further comprises, by weight, at least one member selected from the group consisting of not more than 2.0% of nickel, not more than 2.0% of chromium, not more than 2.0% of calcium, not more than 2.0% of sodium, not more than 2.0% of magnesium, and not more than 2.0% of molybdenum with the balance consisting of iron and unavoidable impurities.

(6) The high strength steel plate according to any one of the above items (1) to (5), which has thereon a zinc alloy plating.

(7) A process for producing a high strength steel plate having improved workability and plating adhesion, comprising the step of subjecting the steel comprising constituents according to any one of the above items (1) to (6) to a treatment involving holding of the steel, after hot rolling, in an atmosphere containing not less than 2% of ammonia in the temperature range of 550 to 800° C. for 2 sec to 10 min.

DESCRIPTION OF THE PREFERRED EMBODIMENTS

Preferred embodiments of the present invention will be described in detail.

At the outset, the reason for the limitation of the chemical composition of the steel plate or steel according to the present invention will be described in detail.

Nitrogen is an element which is most important to the present invention. As with manganese, nitrogen is an austenite former. In particular, nitrogen interacts with manganese to improve the stability of austenite. As a result, the precipitation of carbides during cooling or holding at low temperatures is suppressed. Therefore, the contents of silicon and aluminum, which have hitherto been added for suppressing the formation of carbides, can be reduced, and, in addition, this can improve plating adhesion. When the concentration of nitrogen is less than 0.03% by weight, this contemplated effect cannot be attained. On the other hand, the upper limit of the concentration of nitrogen is 2.0% by weight because enhancing the concentration of nitrogen requires the prolongation of the time necessary for the treatment for the incorporation of nitrogen. The concentration of nitrogen is preferably 0.05 to 1.0% by weight.

Carbon is an element which is enriched in austenite in a temperature region, where two phases coexist, and in a temperature region, where transformation to bainite takes place, to stabilize austenite. By virtue of the effect of this element, austenite is retained even at room temperature, and the transformation induced plasticity can improve the formability. For this reason, in the conventional steel, the carbon content is about 0.1% by weight. On the other hand, in the steel according to the present invention, since nitrogen stabilizes austenite, the carbon content is not particularly limited.

However, the following fact should be noted. In the transformation from austenite, carbon takes complicate behavior depending upon the transformation temperature, that is, transformation to pearlite, upper bainite, lower bainite and the like occurs according to the transformation temperature. Therefore, carbon is also causative of the necessity of close temperature control for retaining austenite during cooling. Further, excessively reducing the carbon content renders the ferrite phase excessively soft although this also depends upon the content of other strengthening element. In this case, deformation does not involve strain induced transformation of the austenite phase, and the deformation is concentrated on only the ferrite phase, leading to breaking which often deteriorates workability.

Further, a high concentration of carbon deteriorates the weldability of the steel plate. When the stability of the transformation behavior, the regulation of strength, and the weldability are taken into consideration, the carbon concentration is preferably not more than 0.08% by weight, more preferably 0.02 to 0.06% by weight.

In the conventional steel, silicon is generally added in an amount of 1 to 2% by weight to suppress the precipitation of cementite and thus to accelerate the enrichment of carbon in austenite, thereby enhancing the stability of austenite. In the steel according to the present invention, however, silicon forms nitride during the treatment for the incorporation of nitrogen and consequently reduces the amount of nitrogen enriched in austenite. For this reason, the addition of an excessive amount of silicon is unfavorable. On the other hand, as described above, silicon is an element useful for strengthening the ferrite phase and improving the formability of the steel plate. Therefore, the silicon content is preferably not more than 0.5% by weight, more preferably 0.01 to 0.2% by weight.

Manganese is an austenite stabilizing element and, at the same time, is an element which, as described above, is useful for strengthening the ferrite phase. When the manganese content is high, however, the band structure becomes significant. This deteriorates properties, and, disadvantageously, spot welds are likely to break within nuggets. Therefore, the manganese content is preferably in the range of 0.5 to 3.0% by weight.

Phosphorus may be added in an amount of not less than 0.01% by weight from the viewpoint of ensuring the strength.

Aluminum is extensively used, in the conventional steel, as a deoxidizer and, in addition, as with silicon, from the viewpoint of suppressing the precipitation of cementite to stabilize austenite. In the steel of the present invention, however, aluminum forms nitrides during the treatment for the incorporation of nitrogen and consequently reduces the amount of nitrogen enriched in austenite. Therefore, the addition of an excessive amount of aluminum is unfavorable. The aluminum content is preferably not more than 0.3% by weight, more preferably not more than 0.1% by weight.

The steel plate according to the present invention basically comprises the above constituents. In addition to these elements and iron, at least one member selected from the group consisting of nickel, chromium, calcium, sodium, magnesium, and molybdenum may be added to stabilize austenite and to increase the amount of retained austenite. The addition of these elements in an excessive amount, however, sometimes increases cost and, at the same time, deteriorates the workability. For this reason, the amount of each of these elements added is limited to not more than 2.0% by weight.

Further, for example, copper and cobalt, which have hitherto been added to the conventional retained austenite steel, for example, for improving the workability and the suitability for plating, are not detrimental to the effect of the present invention when they are added to the steel of the present invention in the same manner as used in the conventional steels.

The ductility of the steel plate as a final product according to the present invention varies depending upon the volume fraction of the retained austenite contained in the product. When the volume fraction of the retained austenite is less than 3% by weight, the effect cannot be clearly attained. On the other hand, when the volume fraction of the retained austenite exceeds 20% by weight, there is a possibility that, when forming is carried out under extremely severe conditions, a large amount of martensite exists in the pressed state. This sometimes poses problems of secondary forming and impact resistance. For this reason, according to the present invention, the volume fraction of the retained austenite is limited to not more than 20% by weight.

Next, the production process of the steel plate according to the present invention will be described.

The characteristic feature of the present invention is that nitrogen is incorporated in a very high concentration which is unexpected from conventional steel plates for working. As can be understood from the conventional steel, it is difficult for the chemical composition to be regulated in the stage of molten steel to incorporate a large amount of nitrogen. However, the application of nitriding to semi-finished steel products or steel plates enables a high concentration of nitrogen to be relatively easily incorporated.

Regarding conditions for nitriding using gas, the steel is held in the temperature range of 550 to 800° C. in an atmosphere containing not less than 2% of ammonia for 2 sec to 10 min. When the temperature is outside the above defined range, the nitriding efficiency is lowered. Therefore, in this case, a long period of time is necessary for providing a necessary level of nitriding. Further, when the temperature is below the lower limit of the above temperature range, iron nitride is formed making it impossible to utilize nitrogen in solid solution which is favorable for retaining austenite necessary in the steel according to the present invention.

The composition of the atmosphere gas is not particularly limited. The concentration of ammonia necessary for the incorporation of nitrogen is limited to not less than 2% from the viewpoint of nitriding efficiency. In the incorporation of nitrogen, the holding time under the temperature and atmosphere conditions according to the present invention is determined by taking into consideration a balance with the necessary amount of nitrogen. When the operation efficiency and the like are taken into consideration, however, the time for holding at the above temperature is limited to 2 sec to 10 min.

The timing of the incorporation of nitrogen may be any stage of semi-finished steel products or annealed plates. Since, however, in the nitriding, the diffusion of nitrogen from the surface of the steel into the steel is utilized, the incorporation of a high concentration of nitrogen becomes easier with reducing the thickness of the plate. For this reason, the incorporation of nitrogen is preferably carried out in or after the step of hot finish rolling. In the production of ordinary cold rolled steel plates, preferably, during the step of recrystallization annealing, an annealing furnace is partially or entirely brought to the temperature and atmosphere conditions according to the present invention to incorporate nitrogen into the plates, from the viewpoint of production.

A process may also be adopted wherein a high concentration of nitrogen is incorporated in the first half of the step and, subsequently, high temperature treatment or holding at a suitable temperature is carried out to stabilize the austenite phase. Further, a process may be adopted wherein recrystallization and imparting a suitable level of ductility are performed by the attainment of the highest temperature in the step of annealing and, thereafter, the treatment for the incorporation of nitrogen is carried out to produce a larger amount of austenite phase. Further, the effect of the present invention can also be attained by combining these processes, or by adopting a process wherein, after recrystallization at a high temperature, nitriding is carried out at a low temperature falling within the scope of the present invention and, thereafter, the temperature is again raised to regulate the structure.

The steel according to the present invention has a lower silicon content than the conventional steels, and thus has a feature that, when the steel of the present invention is used as an original plate for galvanized steel plates, the suitability for plating is good. The thickness of zinc plating is not particularly limited. The thickness, however, is preferably not less than 0.1 $\mu$m from the viewpoint of corrosion resistance and is preferably not more than 10 $\mu$m from the viewpoint of workability.

EXAMPLES

For cold rolled steel plates produced under conventional hot rolling and cold rolling conditions, annealing was carried out, and a part of the annealed plates were plated. Thereafter, the plates were subjected to 0.6% temper rolling to produce steel plates or plated steel plates. The constituents of steels are shown in Table 1. For the steels according to the present invention, the treatment for the incorporation of nitrogen was carried out by holding the plates in an ammonia gas-containing atmosphere in the course of cooling from the highest attainment temperature in the step of annealing, thereby incorporating a high concentration of nitrogen into the plates. The values of nitrogen level shown in Table 1 are those in the final products. The nitrogen level of the steels was regulated by regulating the holding temperature, the holding time, and the concentration of ammonia gas.

Conditions for the treatment for the incorporation of nitrogen are also shown in Table 1. The plating was carried out in a zinc plating bath containing 10% of aluminum. The volume fraction of the retained austenite in the steel plates thus obtained was measured by X-ray diffractometry (five peak method) using MoK$\alpha$ radiation. JIS NO. 5 tensile test pieces were extracted from these steel plates, and were subjected to a cold tensile test under conditions of gage length 50 mm and tensile speed 10 mm/min.

The suitability for plating was evaluated in terms of nonplating and plating adhesion. Whether or not there was nonplating was judged by visual inspection. For the plating adhesion, after a 60-degree V-bending test of the plated steel plates, a tape test was carried out. In this case, when the black level in the tape test was less than 20%, the plating adhesion was regarded as acceptable.

For the weldability, spot welding was carried out under welding conditions of welding current: 10 kA, applied pressure: 22 kg, welding time: 12 cycles, electrode diameter: 6 mm, electrode shape: dome with the tip being 6Φ-40R. In this case, when the number of continuous dots provided until the nugget diameter became less than $4\sqrt{t}$, wherein t represents the plate thickness, exceeded 1000, the weldability was regarded as acceptable.

Materials and the results of evaluation of the suitability for plating are shown in Table 2.

For all the steels according to the present invention, the total elongation was not less than 30% while enjoying a tensile strength of not less than 580 MPa. That is, the steels of the present invention had a combination of high strength with good press formability, and, at the same time, satisfied requirements for the suitability for plating and the weldability.

On the other hand, for the conventional steels wherein the nitrogen content did not fall within the scope of the present invention, the workability before plating was good. However, the workability after plating was deteriorated because heat history in the step of plating resulted in the disappearance of retained austenite. Further, for some of the conventional steels wherein the silicon or aluminum content was high, the suitability for plating was poor. Among the steels of the present invention containing a high concentration of nitrogen, those, wherein the contents of silicon, carbon, manganese, phosphorus, aluminum and the like fell within respective specific ranges, had particularly good workability. Further, the effect of minor elements, such as nickel, chromium, calcium, sodium, magnesium, and molybdenum, was also clear.

TABLE 1

| | Constituents of steel, weight % | | | | | | | | Nitriding conditions | | |
|---|---|---|---|---|---|---|---|---|---|---|---|
| Steel | C | Si | Mn | P | S | Al | N | Others | Temp., ° C. | Time, sec | Ammonia concentration, % |
| A | 0.032 | 0.63 | 1.31 | 0.012 | 0.007 | 0.030 | 0.136 | | 650 | 60 | 5 |
| B | 0.020 | 0.01 | 1.68 | 0.006 | 0.006 | 0.068 | 0.586 | | 650 | 60 | 20 |
| C | 0.001 | 0.18 | 2.23 | 0.009 | 0.004 | 0.16 | 1.355 | | 700 | 120 | 40 |
| D | 0.077 | 0.01 | 0.55 | 0.008 | 0.012 | 0.012 | 0.252 | | 650 | 30 | 20 |
| E | 0.125 | 0.01 | 0.18 | 0.004 | 0.010 | 0.008 | 0.082 | | 680 | 10 | 20 |
| F | 0.046 | 0.04 | 0.34 | 0.011 | 0.010 | 0.016 | 0.194 | Ca: 0.10 | 630 | 60 | 10 |
| G | 0.002 | 0.03 | 2.09 | 0.009 | 0.008 | 0.103 | 0.263 | Na: 0.22<br>Mg: 0.11 | 650 | 30 | 20 |
| H | 0.012 | 0.05 | 0.96 | 0.013 | 0.008 | 0.053 | 0.350 | Cr: 1.6<br>Ni: 0.8 | 650 | 30 | 30 |
| I | 0.080 | 0.79 | 1.67 | 0.004 | 0.005 | 0.13 | 0.024 | | — | — | — |
| J | 0.14 | 1.58 | 0.96 | 0.007 | 0.002 | 0.34 | 0.004 | | — | — | — |

TABLE 2

| No. | Steel | Plating | TS/MPa | El, % | Volume fraction of retained austenite, % | Nonplating | Plating adhesion | Weldability | Remarks |
|---|---|---|---|---|---|---|---|---|---|
| 1 | A | Not done | 610 | 36 | 12 | — | — | ◎ | Steel of |
| 2 | | Done | 610 | 33 | 10 | ○ | ◎ | ○ | invention |
| 3 | B | Not done | 620 | 39 | 16 | — | — | ◎ | Steel of |
| 4 | | Done | 615 | 36 | 12 | ◎ | ◎ | ○ | invention |
| 5 | C | Not done | 700 | 34 | 13 | — | — | ○ | Steel of |
| 6 | | Done | 680 | 31 | 9 | ◎ | ◎ | ○ | invention |
| 7 | D | Not done | 620 | 39 | 10 | — | — | ◎ | Steel of |
| 8 | | Done | 625 | 37 | 8 | ◎ | ◎ | ○ | invention |
| 9 | E | Not done | 600 | 35 | 8 | — | — | ○ | Steel of |
| 10 | | Done | 585 | 32 | 8 | ◎ | ◎ | ○ | invention |
| 11 | F | Not done | 620 | 36 | 12 | — | — | ◎ | Steel of |
| 12 | | Done | 620 | 36 | 12 | ◎ | ◎ | ○ | invention |
| 13 | G | Not done | 600 | 37 | 15 | — | — | ◎ | Steel of |
| 14 | | Done | 610 | 36 | 15 | ◎ | ◎ | ○ | invention |
| 15 | H | Not done | 625 | 38 | 18 | — | — | ◎ | Steel of |
| 16 | | Done | 625 | 39 | 18 | ◎ | ◎ | ○ | invention |
| 17 | I | Not done | 610 | 34 | 6 | — | — | ○ | Comparative |
| 18 | | Done | 560 | 22 | 1 | ○ | ○ | X | steel |
| 19 | J | Not done | 630 | 36 | 9 | — | — | ○ | Comparative |
| 20 | | Done | 570 | 20 | 1 | X | X | X | steel |

In the columns of nonplating, plating adhesion, and weldability,
◎: very good,
○: good, and
X: failure.

As is apparent from the foregoing description, according to the present invention, the regulation of the nitrogen content to ensure the contemplated retained austenite structure can realize high strength steel plates which possess good adhesion to zinc plating and excellent workability.

What is claimed is:

1. A high strength steel plate having improved workability and plating adhesion, comprising, by weight, nitrogen: 0.03 to 2.0% and chromium: not more than 2.0% and having a volume fraction of retained austenite of 3 to 20%.

2. The high strength steel plate according to claim 1, which further comprises, by weight, silicon: not more than 0.5%.

3. The high strength steel plate according to claim 1, which further comprises, by weight, carbon: not more than 0.08%.

4. The high strength steel plate according to claim 1, which further comprises, by weight, at least one member selected from the group consisting of manganese: 0.5 to 3.0%, phosphorus: not less than 0.01%, and aluminum: not more than 0.3%.

5. The high strength steel plate according to claim 1, which further comprises, by weight, at least one member selected from the group consisting of not more than 2.0% of nickel, not more than 2.0% of calcium, not more than 2.0% of sodium, not more than 2.0% of magnesium, and not more than 2.0% of molybdenum with the balance consisting of iron and unavoidable impurities.

6. The high strength steel plate according to claim 1, which has thereon a zinc alloy plating.

7. A process for producing a high strength steel plate having improved workability and plating adhesion, comprising the step of subjecting the steel comprising constituents according to claim 1 to a treatment involving holding of the steel, after hot rolling, in an atmosphere containing not less than 2% of ammonia in the temperature range of 550 to 800° C. for 2 sec to 10 min.

* * * * *